US005433428A

United States Patent [19]

Akashi

[11] Patent Number: 5,433,428

[45] Date of Patent: Jul. 18, 1995

[54] PAPER FEEDING DEVICE OF AN IMAGE FORMING APPARATUS

[75] Inventor: Masakatsu Akashi, Osaka, Japan

[73] Assignee: Mita Industrial Co., Ltd., Osaka, Japan

[21] Appl. No.: 128,105

[22] Filed: Sep. 29, 1993

[30] Foreign Application Priority Data

Oct. 6, 1992 [JP] Japan ..... 4-267543

[51] Int. Cl.[6] ..... B65H 1/08

[52] U.S. Cl. ..... 271/127; 271/160; 271/170; 271/162

[58] Field of Search ..... 271/126, 127, 157, 158, 271/160, 162, 170, 171

[56] References Cited

U.S. PATENT DOCUMENTS

| | | | |
|---|---|---|---|
| 3,588,106 | 6/1971 | Csaba | 271/170 |
| 4,343,461 | 8/1982 | Tomimori et al. | 271/160 X |
| 4,623,137 | 11/1986 | Irie et al. | 271/160 |
| 4,772,007 | 9/1988 | Kashimura | 271/157 X |
| 4,896,871 | 1/1990 | Idenawa | 271/127 X |
| 5,083,880 | 1/1992 | Inomata et al. | 271/162 X |
| 5,205,550 | 4/1993 | Perino | 271/157 |

FOREIGN PATENT DOCUMENTS

| | | | |
|---|---|---|---|
| 55031 | 3/1986 | Japan | 271/157 |
| 295844 | 12/1987 | Japan | 271/127 |
| 31665 | 2/1989 | Japan | 271/170 |
| 192639 | 8/1989 | Japan | 271/157 |
| 24699 | 2/1993 | Japan | 271/170 |

*Primary Examiner*—David H. Bollinger
*Attorney, Agent, or Firm*—Beveridge, DeGrandi, Weilacher & Young

[57] ABSTRACT

A paper feeding device of an image forming apparatus having a paper feeding roller for feeding, one by one, paper pieces stacked in a paper feeding tray. Disposed at the main body of the image forming apparatus are (i) a placing member on which the stacked paper pieces are placed such that the tips thereof are ready for feeding, (ii) a biasing member for upwardly biasing the placing member, (iii) a pair of pawl members for separating, one by one, the stacked paper pieces, and (iv) a pushing-down member for pushing down the placing member as necessary. Against the biasing member, the pushing-down member pushes down the placing member, thus forming a space for setting the paper pieces between the placing member and the pawl members. The stacked paper pieces are inserted into the space through a paper feeding opening. When the pushing-down operation of the pushing-down member is released, the biasing member causes the placing member to be pushed up. This upwardly biases the stacked paper pieces, causing the paper pieces to be ready for feeding. This accomplishes a paper setting.

18 Claims, 10 Drawing Sheets

PAPER FEEDING DEVICE OF AN IMAGE FORMING APPARATUS

BACKGROUND OF THE INVENTION

The present invention relates to a paper feeding device of an image forming apparatus which is disposed at a stack bypass portion of the image forming apparatus for continuously feeding stacked paper pieces.

Conventionally, a paper feeding device of the type above-mentioned employs a so-called friction pad separating system in which a friction pad is pressed to and contacted with the top surface of stacked paper pieces, causing the highest paper piece to be separated from the remaining paper pieces.

However, the friction pad separating system requires a number of component elements such as spring clutch means, solenoid means and the like. This complicates the structure and increases the production cost.

Further, paper powder sticking to the friction pad, lowers frictional resistance applied to paper, thus causing the highest paper piece to be defectively separated from other stacked paper pieces. To prevent such a defective separation, it is required to carry out, relatively often, a maintenance such as replacement of the friction pad or the like.

In the friction pad separating system, it is required to replenish paper pushed between the friction pad and a roller or the like opposite thereto. This disadvantageously lowers the maneuverability of paper replenishment.

On the other hand, there is often used, as a clutch mechanism to be used in a paper feeding device or the like, a spring clutch system in which a solenoid is operated, as necessary, to reduce a coil spring in diameter, and the coil spring is wound on a boss at the drive or driven side, so that a drive force is to be transmitted.

However, when a metallic coil spring is used in this spring clutch system, the boss at the side with which the coil spring comes in slide contact (the drive input side) is required to be made of metal having a smooth surface. Accordingly, the surface is required to be polished, resulting in an increase in production cost.

On the other hand, when a resin spring is used, the boss is not required to be made of metal. However, the load to be applied cannot be so great. Accordingly, a drive force to be transmitted is small.

When such spring clutches are used in paper feeding devices, the positions where the paper feeding rollers are stopped, vary front one another with variations of dimensional precision of the boss diameters or the spring diameters, regardless of the bosses made of metal or resin. Accordingly, it is required, at the time of assembling, to properly adjust the paper feeding roller's stop positions by a method of adjusting the spring engagement positions or the like.

SUMMARY OF THE INVENTION

It is a first object of the present invention to provide an economical paper feeding device of an image forming apparatus excellent in maintenance efficiency and maneuverability of paper replenishment.

It is a second object of the present invention to provide an economical clutch mechanism which can transmit a great drive force and for which no adjustment is required at the time of assembling.

To achieve the first object, the present invention provides, as an aspect thereof, a paper feeding device of an image forming apparatus, comprising: a paper feeding tray which is disposed at a lateral side of the main body of said image forming apparatus and in which a plurality of paper pieces are stacked as set such that the tips thereof are inserted into a paper feeding opening of said lateral side; paper feeding roller means adapted to be rotatably driven as coming in contact with the top surface of said stacked paper pieces; a placing member on the top surface of which said stacked paper pieces are placed as set such that the tips thereof are ready for feeding, said placing member being disposed under said paper feeding roller means in a manner vertically movable with respect to said main body; stacked paper pieces biasing means for upwardly biasing said stacked paper pieces through said placing member; a pair of pawl members adapted to be engaged with said tips of said stacked paper pieces as upwardly biased, the highest paper piece of said stacked paper pieces being separated from other paper pieces by the cooperation of said pawl members with said paper feeding roller means; and pushing-down means for pushing down, as necessary, said placing member against said stacked paper pieces biasing means such that there is formed a space for setting said plurality of paper pieces between said placing member and said pawl members; said placing member, said stacked paper pieces biasing means, said pawl members and said pushing-down means being disposed at said main body of said image forming apparatus.

According to the arrangement above-mentioned, the pushing-down means pushes down the placing member against the biasing means, thus forming the space for setting the paper pieces between the placing member and the pawl members. Then, the stacked paper pieces are inserted into the space through a paper feeding opening. Thereafter, when the pushing-down operation of the pushing-down means is released, the biasing means pushes up the placing member to upwardly bias the paper pieces such that the paper pieces are ready for feeding. Paper setting is thus finished.

The pawl members are used for separating the paper pieces, and the pawl members and the placing member are disposed at the main body of the image forming apparatus. Accordingly, the paper feeding device of the present invention can be made simple in structure with a low cost as compared with a conventional friction pad system. Further, unlike the friction pad system, the present invention does not cause the problem of generation of paper powder or the like, thus enabling the maintenance to be facilitated. Further, by pushing down the placing member by the pushing-down means, there is assured a space sufficient for setting the paper pieces. This enables the paper pieces to be readily replenished, thus providing a good maneuverability of paper replenishment.

Preferably, the present invention further comprises a stopper member which is disposed at said paper feeding opening and which is movable between a regulating position for regulating the insertion of said paper pieces through said paper feeding opening, and a regulation-releasing position for releasing the regulation above-mentioned.

According to the arrangement above-mentioned, when it is not required to feed paper by the paper feeding device, the stopper member can be moved to the regulating position for regulating the insertion of the paper pieces into the inner part of the paper feeding opening. This securely prevents the paper pieces from being undesirably fed to provoke a paper jam or the like. Preferably, the present invention has a stopper-member interlocking mechanism to be interlocked with the pushing-down operation of the pushing-down means, thereby to move the stopper member to the regulation-releasing position. According to the arrangement above-mentioned, when the placing member is pushed down by the pushing-down means, the stopper member is automatically moved to the regulation-releasing position, enabling the paper pieces to be inserted into the inner part of the paper feeding opening. A single operation of the pushing-down means enables the placing member and the stopper member to be respectively moved to desired positions. This provides a good maneuverability.

Preferably, the present invention further comprises a guide member movable between (i) a lower position where said guide member comes in contact with said top of said tips of said stacked paper pieces inserted to a setting position through said paper feeding opening such that said tips of said paper pieces are guided to the space, and (ii) an upper position where the passage of each paper piece as fed is allowed.

According to the arrangement above-mentioned, when inserting the stacked paper pieces to the setting position through the paper feeding opening, the guide member located in the lower position comes in contact with the top of the tips of the paper pieces. This securely guides the tips of the paper pieces into the space.

Preferably, the present invention further comprises a guide-member interlocking mechanism to be interlocked with the pushing-down operation of said pushing-down means, thereby to move said guide member to said lower position.

According to the arrangement above-mentioned, when the placing member is pushed down by the pushing-down means, the guide member is automatically moved to the lower position, thus enabling the inserted paper pieces to be guided to the setting position. A single operation of the pushing-down means enables the placing member and the guide member to be respectively moved to desired positions. This provides a good maneuverability.

To achieve the second object, the present invention provides, as an aspect thereof, a clutch mechanism for transmitting, as necessary, the rotation of a drive gear to be rotated in association with a drive source, to a driven member, the clutch mechanism comprising: a follower gear rotatable integrally with the driven member and meshed with the drive gear, the follower gear lacking portions of the teeth thereof in order to partially prevent the follower gear from being meshed with the drive gear; a rotary pawl member rotatable integrally with the driven member and having a pawl portion; rotary pawl member biasing means for biasing said rotary pawl member in a predetermined rotation direction, the biasing force of said rotary pawl member biasing means causing the follower gear and the drive gear to be meshed with each other through the rotary pawl member; and solenoid means having an engaging portion engageable with the pawl portion of the rotary pawl member, the solenoid means being adapted to hold, against the rotary pawl member biasing means, the follower gear at a rotation position where the follower gear is not meshed with the drive gear, with the engaging portion engaged, as necessary, with the pawl portion of the rotary pawl member to prevent the driven member from being rotated in a predetermined direction.

According to the arrangement above-mentioned, with the engaging portion of the solenoid means engaged with the pawl portion of the rotary pawl member to prevent the follower gear from being rotated in a predetermined direction, the follower gear is held, against the rotary pawl member biasing means, at a rotation position where the follower gear is not meshed with the drive gear. This intercepts the transmission of a drive force to the driven member.

On the other hand, when the engagement of the engaging portion of the solenoid means with the pawl portion of the rotary pawl member is released, the follower gear is allowed to be rotated, by the rotary pawl member biasing means, to a position where the follower gear is meshed with the drive gear. Accordingly, the rotation of the drive gear is transmitted to the driven member through the follower gear.

The present invention eliminates the use of expensive polished metal required when a metal spring is used in a conventional spring clutch system. This reduces the production cost. Further, since there is used a gear connection between the drive gear and the follower gear, the drive force to be transmitted can be made great. Further, in the conventional spring clutch system, the spring clutch is required to be adjusted, at the time of assembling, such that the follower member's stop position is proper. However, the clutch mechanism in the present invention eliminates such adjustment at the time of assembling.

DETAILED DESCRIPTION OF THE PREFERRED EMBODIMENTS

The following will discuss in detail the present invention with reference to the attached drawings illustrating an embodiment thereof.

Figure 1:
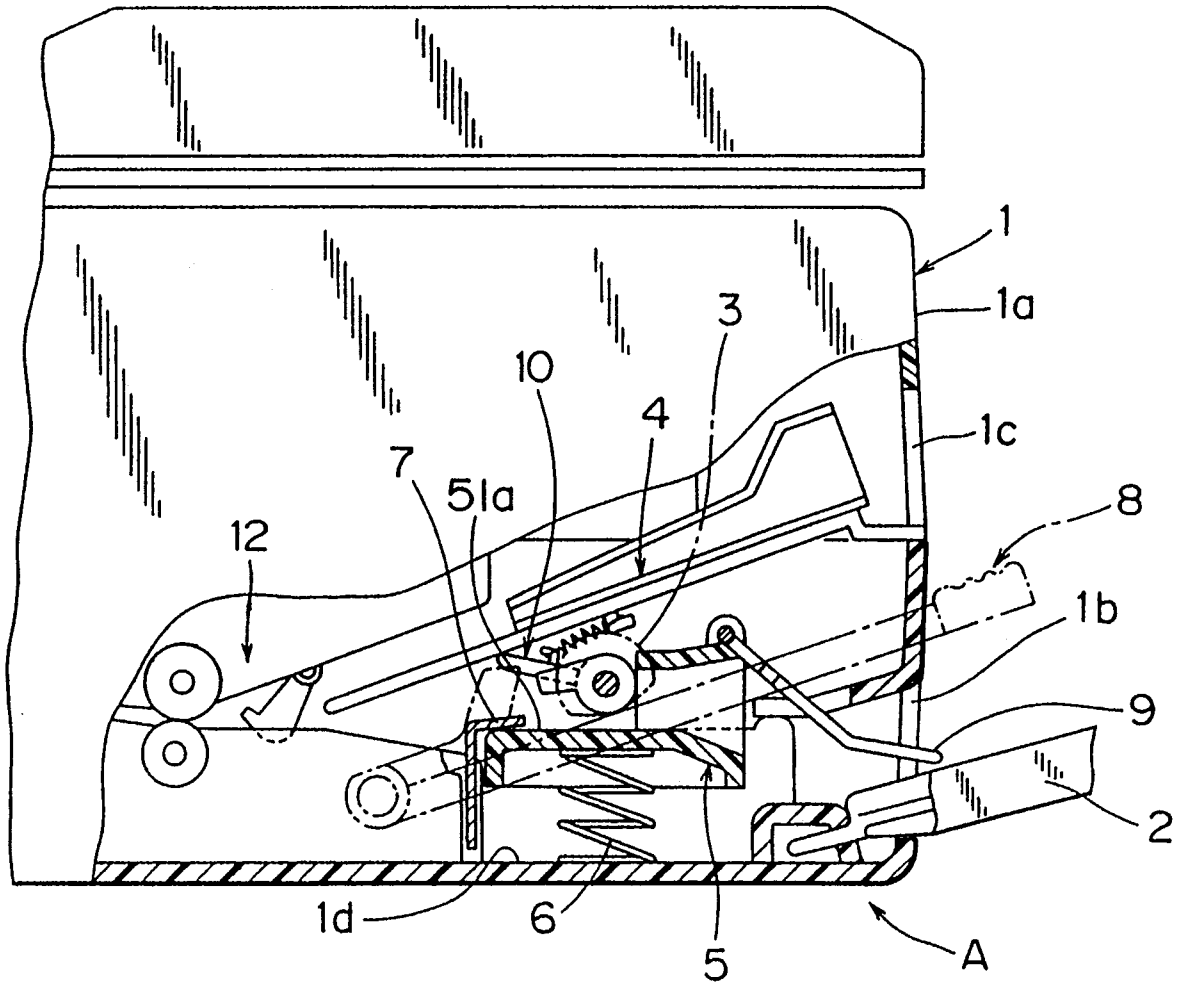
FIG. 1 is a side view, with main portions shown in section, of a copying apparatus including a paper feeding device according to an embodiment of the present invention, without the stack bypass portion utilized.

With reference to FIG. 1, a paper feeding device A is made in the form of a stack bypass portion in which, through a paper feeding opening 1*b* in a lateral side 1*a* of the main body 1 of an image forming apparatus, a plurality of paper pieces P stacked in a paper feeding tray 2 are continuously fed, one by one, by a paper feeding roller 3 which comes in contact with the top surface of the stacked paper pieces P. Resist means 12 for controlling the delivery timing of the paper pieces P is disposed at the stack bypass portion at the downstream end thereof in the paper feeding direction.

Disposed above the paper feeding device A serving as the stack bypass portion are (i) an opening 1*c* in the lateral side 1*a* of the main body 1 of the image forming apparatus and (ii) a manual paper feeding unit for feeding paper through a guide member 4.

Figure 2:
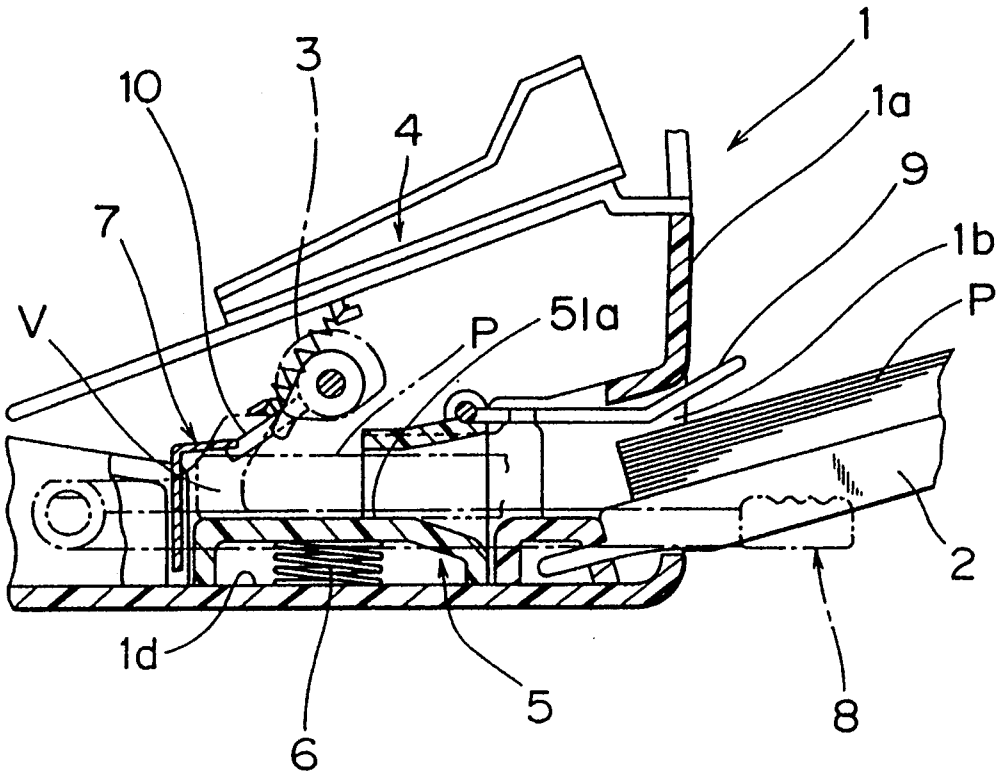
FIG. 2 is a side view, with main portions shown in section, of the copying apparatus with the stack bypass portion utilized.
Figure 3:
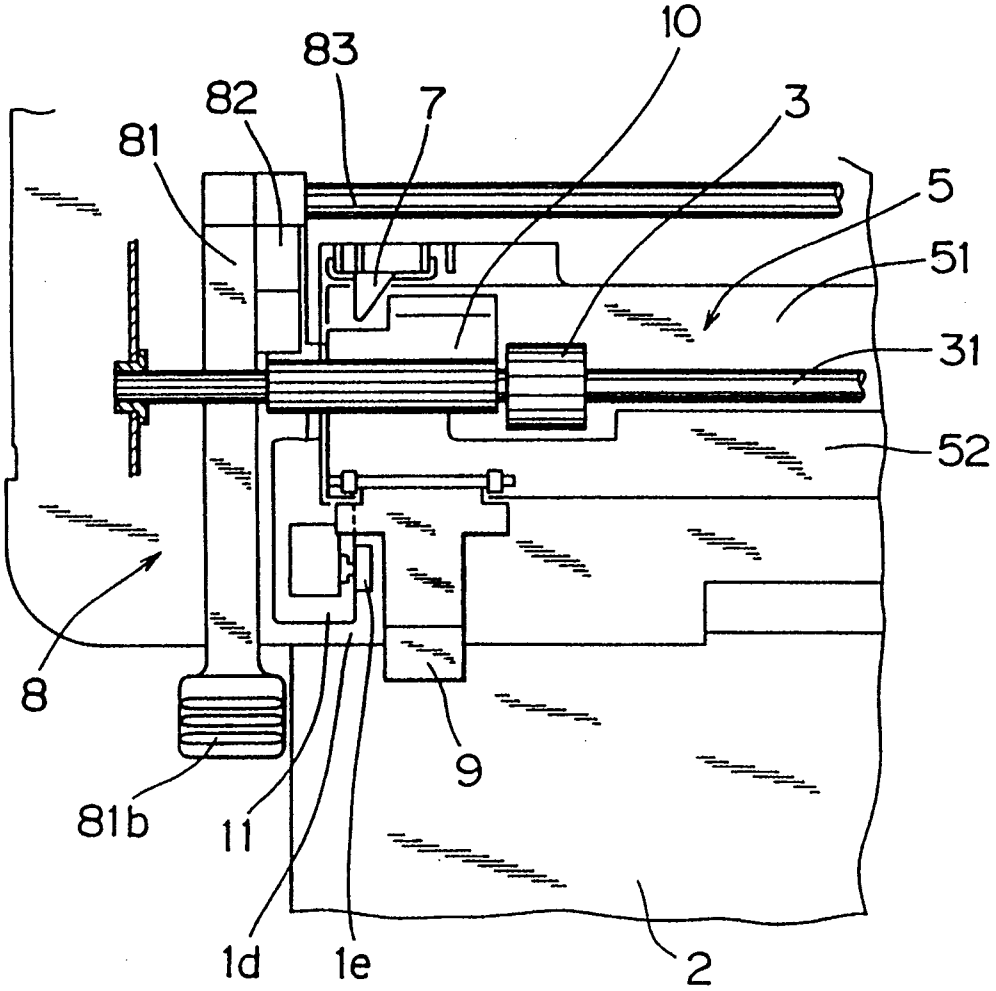
FIG. 3 is a plan view of the paper feeding device of the present invention.

Referring to FIGS. 1 to 3, the paper feeding device A has (i) the paper feeding tray 2 in which a plurality of paper pieces P are stacked, (ii) the paper feeding roller 3 for feeding, one by one, the paper pieces P, (iii) a drive transmission mechanism B for transmitting the power of a drive source to the paper feeding roller 3, (iv) a placing member 5 on which the tips of the paper pieces P are to be placed, (v) a compression spring 6 serving as biasing means for upwardly biasing the paper pieces P through the placing member 5, (vi) a pair of pawl members 7 adapted to come in contact with the top of the tips of the paper pieces P upwardly biased, thereby to prevent the paper pieces P from springing out and to arrange the paper pieces P in such a manner as to be fed one by one, (vii) a pushing-down member 8 for pushing down, as necessary, the placing member 5 against the compression spring 6, (viii) a stopper member 9 adapted to be driven in association with the pushing-down member 8 for regulating the insertion of the paper pieces P toward the inner part of the paper feeding opening 1*b*, and (ix) a guide member 10 adapted to be driven in association with the pushing-down member 8 to guide the insertion of the paper pieces P.

The paper feeding tray 2 as inserted into a lower part of the paper feeding opening 1*b*, is removably attached to an inner bottom portion 1*d* of the main body 1 of the image forming apparatus.

The paper feeding roller 3 is made of rubber integrally rotatably attached to a long rotary shaft 31, and has a substantially semicircular section. The peripheral surface of the paper feeding roller 3 includes a cylindrical surface 3*a* to be used for feeding. paper, and notched surfaces 3*b* having two notched surfaces which intersect each other at an obtuse angle for preventing paper from being fed.

The placing member 5 is disposed under the paper feeding roller 3 in the inner part of the paper feeding opening 1*b*, and vertically movably attached to a rib standing from the inner bottom portion 1*d* of the main body 1 of the image forming apparatus. Placed on the placing member 5 are the paper pieces P as set such that the tips thereof are ready for feeding (as shown by a chain double-dashed line in FIG. 2).

Figure 4:
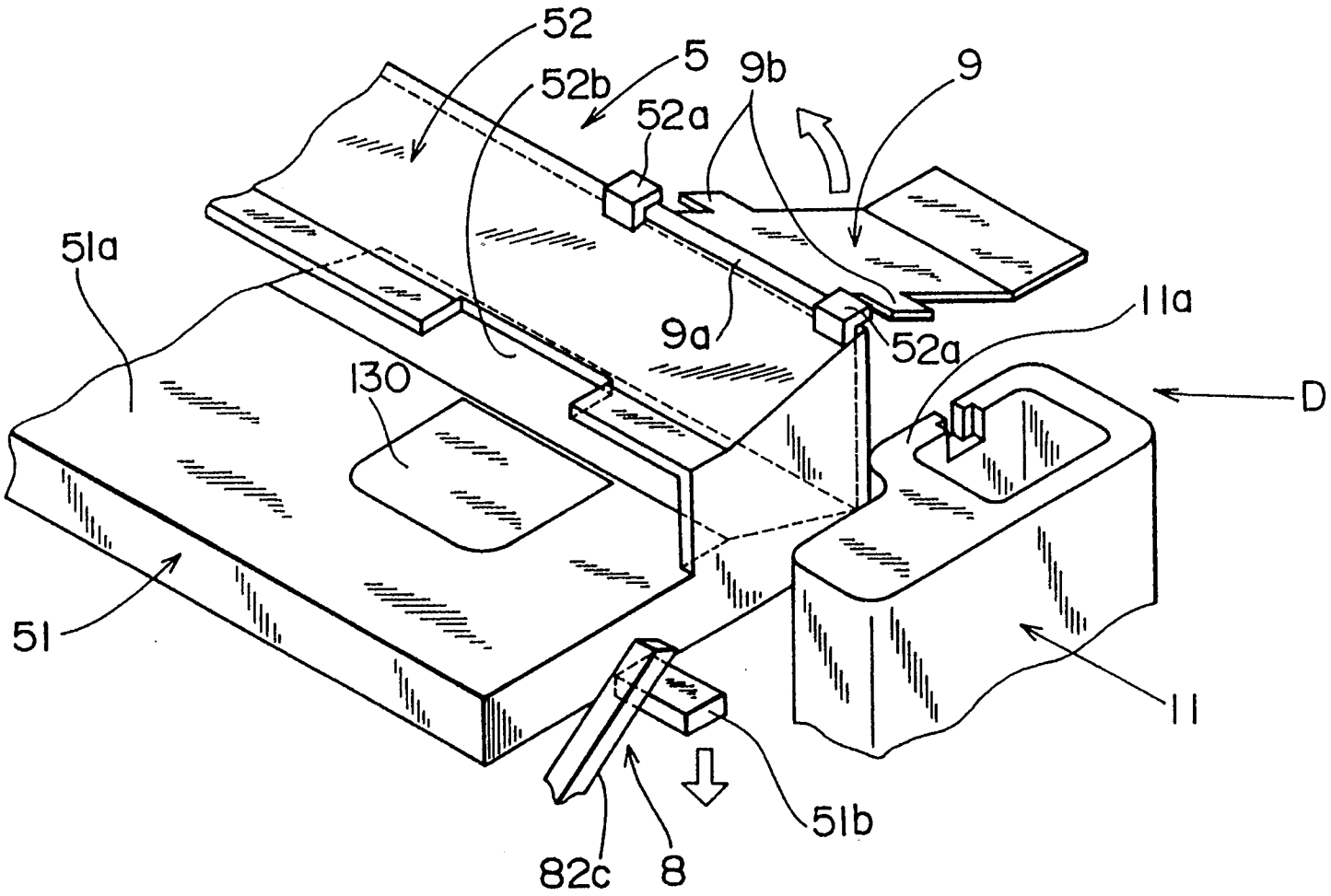
FIG. 4 is a perspective view of main portions of the placing member.
Figure 5:
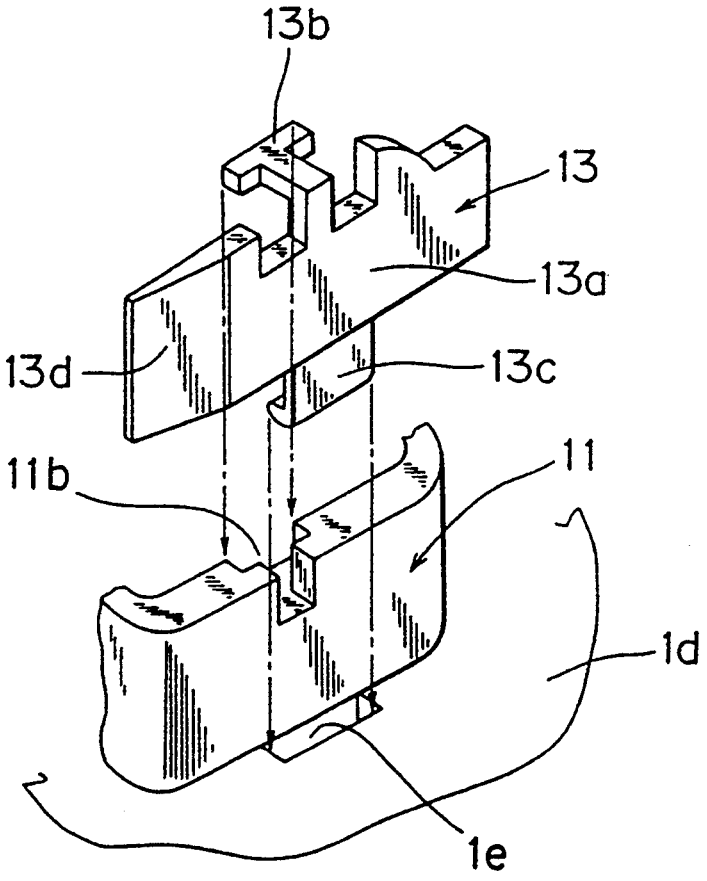
FIG. 5 is an exploded perspective view illustrating how a paper width adjusting member is attached.

Referring to FIGS. 1 and 4, the placing member 5 has a container-like portion 51 of which the bottom is opened, and a bridge-like portion 52 integrally formed on the top surface of the container-like portion 51. The top surface of the container-like portion 51 serves as a placing portion 51*a* on which the paper pieces P as set are placed. A plate-like cushion member 130 is attached to the placing portion 51*a*. Between the paper-introducing-side end and the center portion of the placing portion 51*a*, the bridge-like portion 52 is formed by a channel member for guiding the top surface of the paper pieces P under introduction.

The container-like portion 51 is integrally provided at both lateral sides thereof with a pair of projections 51*b*. Provision is made such that, when the projections 51*b* are pushed down by the pushing-down operation of a finger-pushing lever 81, to be discussed later, of the pushing-down member 8, the placing member 5 is pushed down.

The bridge-like portion 52 is provided at both lateral sides of the top surface of the front end (the paper-introducing-side end) thereof with a pair of hook-like projections 52*a*. The hook-like projections 52*a* rotatably support the stopper member 9. When the placing member 5 is located in an upper position shown in FIG. 1, the stopper member 9 hangs down to the extent that the stopper member 9 comes in contact with the top surface of the paper feeding tray 2. Thus, the stopper member 9 is located in a regulating position where the paper pieces P are prevented from being inserted through the paper feeding opening 1*b* (See FIG. 1). When the placing member 5 is located in the lower position shown in FIG. 2, the stopper member 9 is pushed up by shoulder portions 11*a* of casing ribs 11 which stand from the inner bottom portion 1*d* of the main body 1 of the image forming apparatus. Thus, the stopper member 9 is located in a regulation-releasing position where the insertion of the paper pieces P through the paper feeding opening 1*b* is allowed (See FIG. 2). The bridge-like portion 52 is provided at the rear end portion thereof with a notched portion 52*b* into which the paper feeding roller 3 enters.

Referring to FIGS. 2 to 5, a pair of casing ribs 11 are so disposed as to be opposite to each other in a direction at a right angle to the paper feeding direction. A paper width adjusting member 13 is adapted to be removably attached to each of the opposite surfaces of the casing ribs 11. Each paper width adjusting member 13 has (i) a paper width adjusting member main body 13*a*, (ii) an engagement projection 13*b* which upwardly extends from a concave portion in the top surface of the main body 13*a*, which is then outwardly bent and which further extends in the back and forth direction, and (iii) a pawl portion 13*c* projecting from the underside of the main body 13*a*. The main body 13*a* has a front end 13*d* of which thickness is reduced in the direction toward the upstream side of the paper feeding direction. This facilitates the introduction of the paper pieces P. Each of the casing ribs 11 has an indentation 11*b* in which the engagement projection 13*b* of each paper width adjusting member 13 is fitted. The main body 1 of the image forming apparatus is provided in the inner bottom portion 1*d* with recesses 1*e* in and with which the pawl portions 13*c* of the paper width adjusting members 13 are inserted and engaged. By attaching or removing the paper width adjusting members 13, it is possible to readily cope with the width of paper to be used.

The compression spring 6 is disposed between the inner bottom portion 1*d* of the main body 1 of the image forming apparatus and the bottom of the placing member 5 for upwardly biasing the placing member 5.

Figure 7:
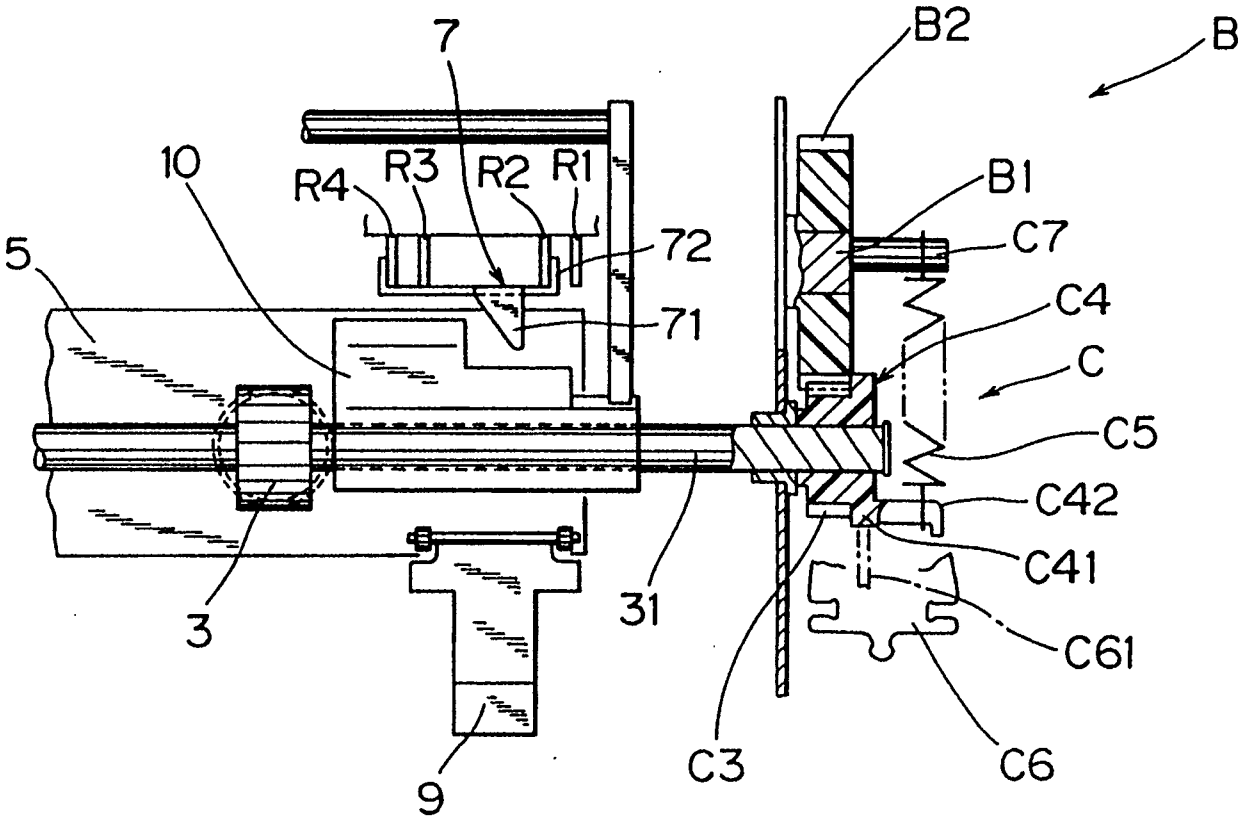
FIG. 7 is a plan view, with portions shown in section, of a drive transmission mechanism for transmitting a drive force to the paper feeding roller.

Referring to FIG. 7, each of the pawl members 7 has a main body 71 having a channel section in plan elevation, and a pawl portion 72 extending in the opposite direction to the paper feeding direction from the top surface of the main body 71. Each pawl member 7 is removably attached to first to fourth ribs R1 to R4 disposed at the main body 1 of the image forming apparatus. The first ribs R1 are disposed at the outermost positions, and the second, third and fourth ribs R2 to R4 are successively disposed in the direction from the outermost positions toward the innermost positions. By selecting the ribs to be attached, the pawl members 7 may be selectively disposed at outer positions corresponding to paper having a narrow width (See FIG. 7), or at inner positions corresponding to paper having a wide width. When the main bodies 71 are engaged with the first ribs R1 and the third ribs R3, the pawl members 7 are disposed at the outer positions. When the main bodies 71 are engaged with the innermost fourth ribs R4 and the second ribs R2, the pawl members 7 are disposed at the inner positions.

Between the main bodies 71 of the pawl members 7 and the placing portion 51*a* of the placing member 5 as pushed down, there is adapted to be formed a space V for setting the paper pieces P, as shown in FIG. 2. When the tips of the paper pieces P are introduced in this space V (as shown by the chain double-dashed line in FIG. 2), there is provided a setting state where paper is ready for feeding.

Figure 6:
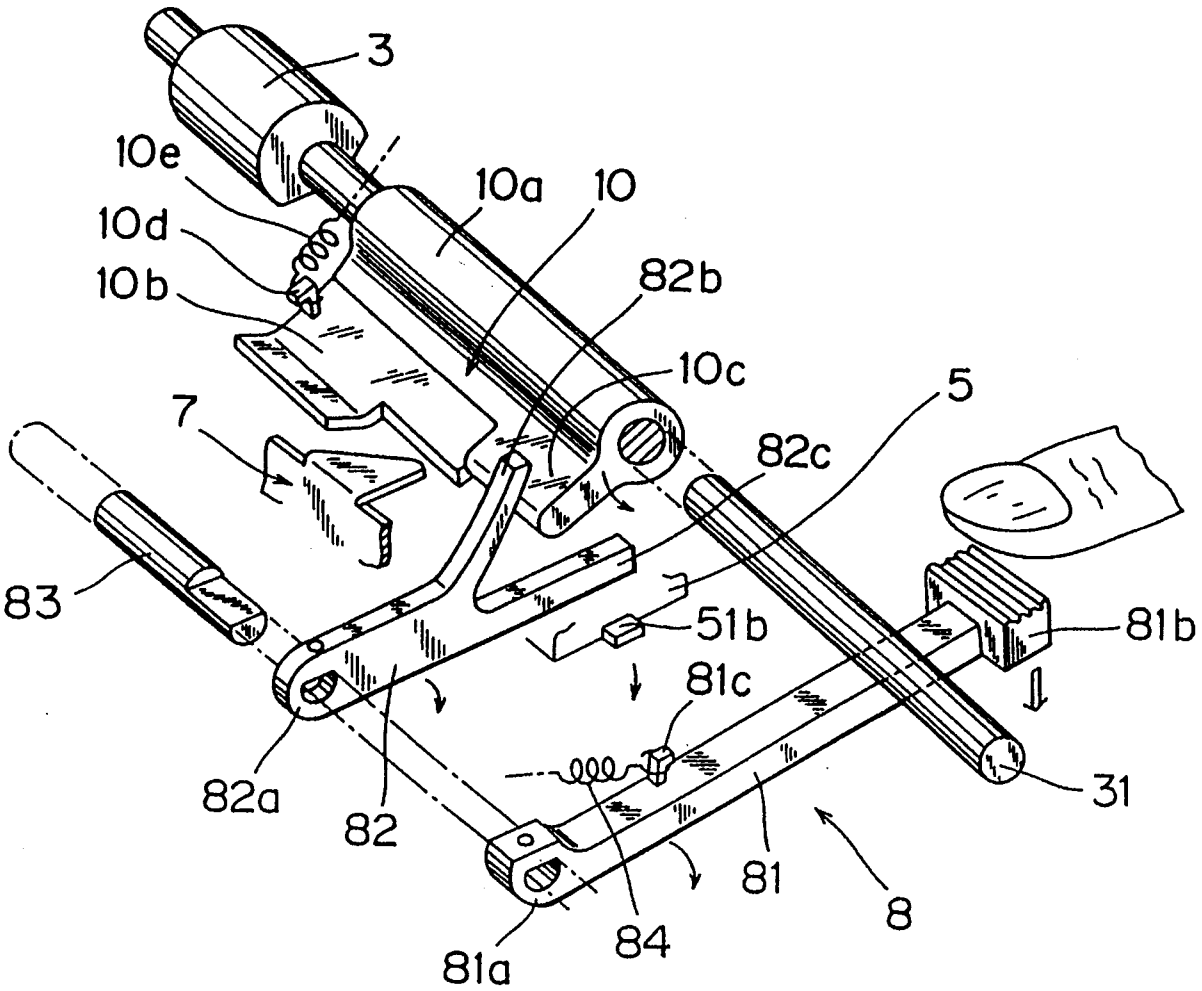
FIG. 6 is an exploded perspective view illustrating the operation of the paper feeding device.

Referring to FIGS. 1, 3 and 6, the pushing-down member 8 has (i) a finger-pushing lever 81 of which base end 81*a* is integrally rotatably attached to an end of a support shaft 83, and (ii) a working lever 82 as branched into two portions. The base end 81*a* is integrally rotatably attached to the support shaft 83, and a tip 81*b* on which a finger is to be put, projects outside of the main body 1 of the image forming apparatus. The finger-pushing lever 81 is provided at an intermediate portion thereof with a hook portion 81*c*. Disposed at the hook portion 81*c* is a tension spring 84 for biasing the finger-pushing lever 81 in the counterclockwise direction (in the pushing-up direction). Normally, the finger-pushing lever 81 is biased in the state shown in FIG. 1 by the tension spring 84. The working lever 82 has (i) a base end 82*a* integrally rotatably attached to the support shaft 83, (ii) a guide-member interlocking rod 82*b* serving as a guidemember interlocking mechanism which forms an upper branched portion, and (iii) a placing-member interlocking rod 82*c* which forms a lower branched portion.

When the tip 81*b* of the finger-pushing lever 81 of the pushing-down member 8 is pushed down by a finger, the support shaft 83 is rotated clockwise in FIG. 1 to rotate the working lever 82 clockwise. Accordingly, the placing-member interlocking rod 82*c* of the working lever 82 pushes down the placing member 5 through the projections 51*b* thereof, so that the space V is formed between the pawl members 7 and the placing portion 51*a* of the placing member 5. On the other hand, as the finger-pushing lever 81 is pushed down, the guide-member interlocking rod 82*b* of the working lever 82 causes the guide member 10 to be rotated counterclockwise and moved downwardly. At this lower position, the guide member 10 comes in contact with the top surface of the tips of the stacked paper pieces P which are inserted through the paper feeding opening 1*b*. Thus, the tips of the paper pieces P thus inserted are guided into the space V. The guide member 10 as biased in the clockwise direction by a tension spring 10*e* to be discussed later, is moved to the upper position where the passage of each paper piece as fed is allowed.

Referring to FIG. 4, the stopper member 9 is supported by the hook-like projections 52*a* of the bridge-like portion 52 of the placing member 5 in a manner rotatable around a shaft portion 9*a* at the base end of the stopper member 9. The stopper member 9 is provided at intermediate portions at both lateral sides thereof with a pair of projections 9*b*. As the placing member 5 is moved up and down, the projections 9*b* of the stopper member 9 are relatively moved down and up with respect to the shaft portion 9*a*. Accordingly, the stopper member 9 can be moved to the regulating position and the regulation-releasing position mentioned earlier. The placing-member interlocking rod 82*c* of the pushing-down member 8, the placing member 5 and the casing ribs 11 form a stopper member interlocking mechanism D.

The guide member 10 has (i) a casing portion 10*a* relatively rotatably attached to an intermediate portion of the rotary shaft 31 of the paper feeding roller 3, (ii) a guide-member main body 10*b* integral with the casing portion 10*a*, and (iii) a pushed portion 10*c* which is integral with the casing portion 10*a* and which is adapted to be pushed by the guide-member interlocking rod 82*b* of the pushing-down member 8. The guide-member main body 10*b* is provided at an end thereof with a hook-like projection 10*d*. Disposed at the hook-like projection 10*d* is the tension spring 10*e* for biasing the guide member 10 clockwise in FIG. 1. The guide member 10 is normally located in the upper position by the operation of the tension spring 10*e*.

Referring to FIGS. 7 to 10, the drive transmission mechanism B is adapted to transmit a driving force of a motor (not shown) serving as a drive source to the paper feeding roller 3. The drive transmission mechanism B has (i) a drive shaft B1 to be interlockingly rotated with the motor, (ii) a drive gear B2 which is coaxial with the drive shaft B1 and which is adapted to be interlockingly rotated therewith, and (iii) a clutch mechanism C for transmitting, as necessary, the rotation of the drive gear B2 to the rotary shaft 31 of the paper feeding roller 3 serving as a driven member, thereby to rotate the paper feeding roller 3 in the paper feeding rotation direction.

Figure 8:
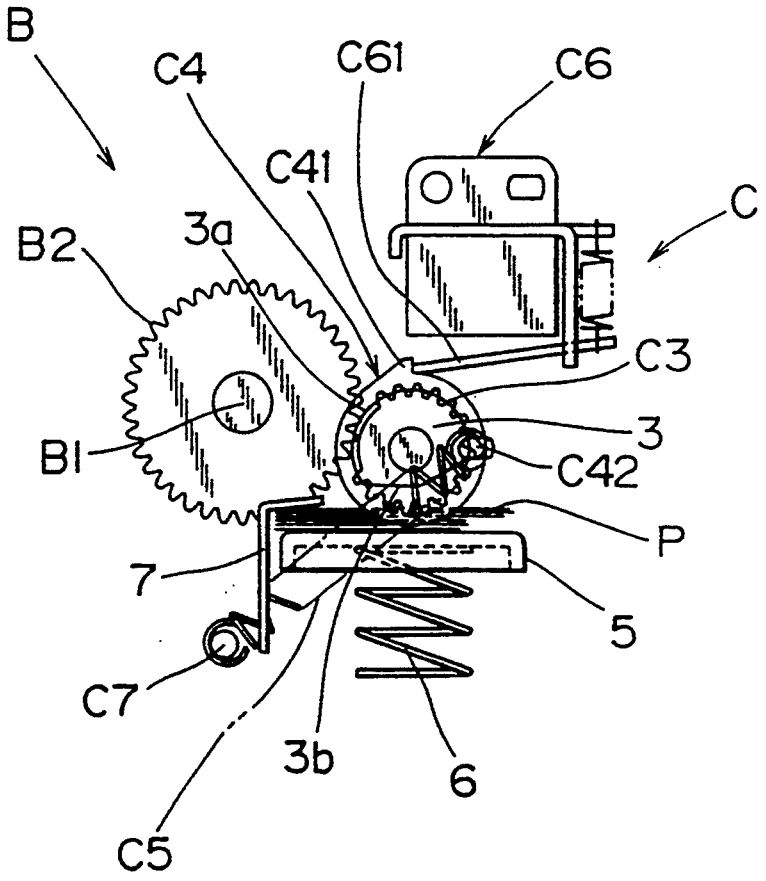
FIG. 8 is a schematic side view of the drive transmission mechanism with the clutch mechanism disconnected.

Referring to FIG. 8, the clutch mechanism C has (i) a follower gear C3 which is rotatable integrally with the rotary shaft 31 of the paper feeding roller 3 and which is adapted to be meshed with the drive gear B2, (ii) a rotary pawl member C4 integral with the follower gear C3, (iii) a tension spring C5 serving as biasing means for biasing the rotary pawl member C4 in the paper feeding rotation direction of the paper feeding roller 3, and (iv) a solenoid C6 having an operating rod C61 which can be hooked to a pawl portion C41 of the rotary pawl member C4.

The follower gear C3 is formed as lacking some teeth in order to partially prevent the follower gear C3 from being meshed with the drive gear B2.

The tension spring C5 is hooked at both ends thereof by a hooking shaft C42 projecting from the rotary pawl member C4 and by a hooking shaft C7 standing from a lateral plate of the main body 1 of the image forming apparatus. The tension spring C5 normally biases the rotary pawl member C4 in the paper feeding rotation direction (in the clockwise direction in FIG. 8). This biasing force causes the follower gear C3 integral with the rotary pawl member C4 to be meshed with the drive gear B2.

As shown in FIG. 8, the solenoid C6 is arranged such that, when the operating rod C61 is hooked to the pawl portion C41 of the rotary claw member C4 to regulate the clockwise rotation of the follower gear C3 in FIG.

Figure 9:
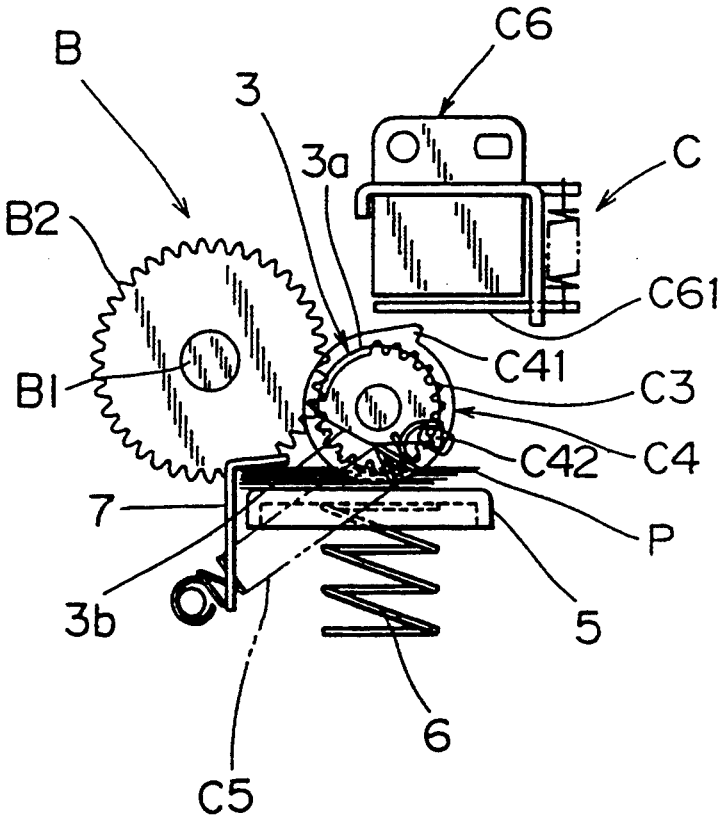
FIG. 9 is a schematic side view of the drive transmission mechanism, illustrating a state where the clutch mechanism starts being connected.
Figure 10:
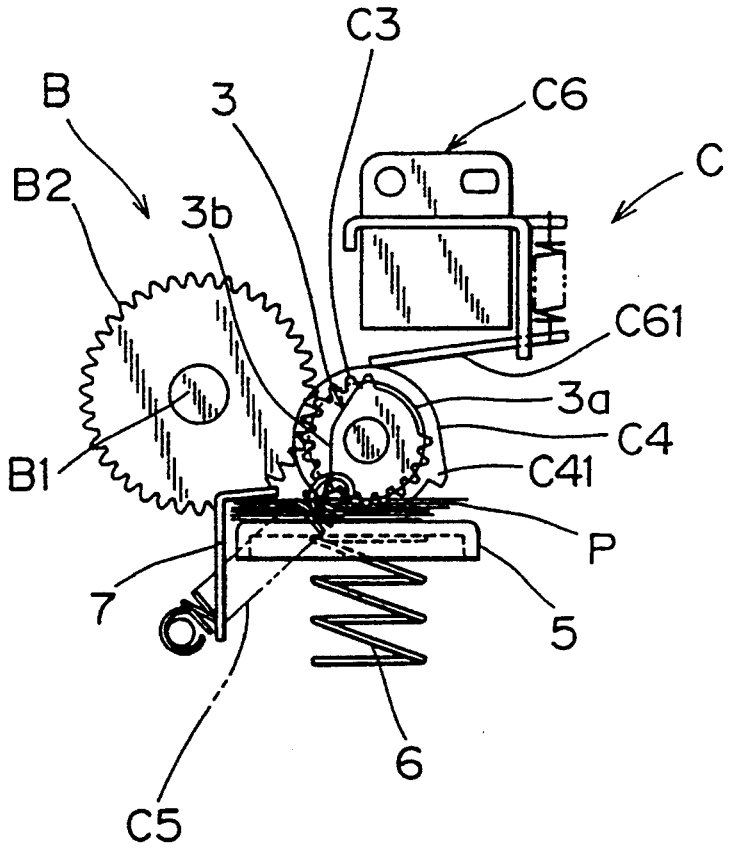
FIG. 10 is a schematic side view of the drive transmission mechanism, illustrating a state where the clutch mechanism is connected to drive the paper feeding roller.

8, the follower gear C3 is held, against the tension spring C5, at a rotation position where the follower gear C3 is not meshed with the drive gear B2. Further, the solenoid C6 is arranged such that, when the operating rod C61 is released, as necessary, from a state where the operating rod C61 is hooked to the pawl portion C41 of the rotary pawl member C4, the follower gear C3 is allowed to be rotated, by the tension spring C5, to a position where the follower gear C3 is meshed with the drive gear B2 (See FIGS. 9 and 10 in which FIG. 9 shows a state where the gears B2 and C3 start being meshed with each other, while FIG. 10 shows a state where the gears B2 and C3 are meshed with each other to drive the paper feeding roller 3).

The clutch mechanism C having the arrangement above-mentioned, is superior to a conventional spring clutch mechanism in the following points. In the spring clutch, the boss at the drive input side is required to be made of metal having a smooth surface (polished metal, sintered metal or the like), and is therefore expensive. Further, when such spring clutches are used in paper feeding devices, the positions where the paper feeding rollers are stopped, vary with variations of dimensional precision of the spring diameters, the diameters of the members on which the springs are wound, and the like. Accordingly, such variations must be adjusted at the time of assembling of the spring clutches. On the other hand, the clutch mechanism C in the embodiment above-mentioned is simple in structure and low in cost, requires no adjustment at the time of assembling, and assures a reliable operation.

According to the embodiment above-mentioned, the finger-pushing lever 81 of the pushing-down member 8 may be operated to push down the placing member 5 against the compression spring 6, thus forming the space V for setting the paper pieces P between the placing member 5 and the pawl members 7 (See FIG. 2). After the stacked paper pieces P have been inserted into the space V through the paper feeding opening 1*b*, the placing member 5 as pushed down by the pushing-down member 8 may be released. Accordingly, the compression spring 6 pushes up the placing member 5 to upwardly bias the paper pieces P, causing the paper pieces P to be ready for feeding. Thus, paper setting is finished.

The pawl members 7 are used for separating paper, and the placing member 5 and the pawl members 7 are disposed at the side of the main body 1 of the image forming apparatus. Accordingly, the paper feeding device of the present invention can be made simple in structure with a low cost, as compared with the conventional friction pad system. Further, unlike the friction pad system, the present invention does not cause the problem of generation of paper powder or the like, thus enabling the maintenance to be facilitated. Further, by pushing down the placing member 5 by the pushing-down member 8, there is assured the space V sufficient for setting the paper pieces P. This enables the paper pieces P to be readily replenished, thus providing a good maneuverability of paper replenishment.

Further, in association with the lever operation of the pushing-down member 8, the placing member 5, the stopper member 9 and the guide member 10 can be respectively moved to desired positions, thus providing a good maneuverability.

Further, when inserting the stacked paper pieces P through the paper feeding opening 1*b*, the guide member 10 moved to the lower position by the operation of the finger-pushing lever 81, securely guides the tips of the paper pieces P toward the space V. This enables the paper pieces P to be securely brought to the setting position.

While the finger-pushing lever 81 is not operated, the stopper member 9 located in the regulating position prevents the paper pieces P from being inserted into the inner part of the paper feeding opening 1*b*. This securely prevents paper from being undesirably fed to provoke a paper jam or the like.

The present invention is not limited to the embodiment above-mentioned, but a variety of design modifications thereof may be made without departing from the spirit of the present invention.

We claim:

1. A paper feeding device of an image forming apparatus, said device comprising:

a paper feeding tray which is disposable at a lateral side of a main body of said image forming apparatus and in which a plurality of paper pieces are to be stacked so that tips thereof are inserted into a paper feeding opening of said lateral side;

paper feeding roller means, adapted to be rotatably driven to come in contact with a top surface of paper pieces stacked in said paper feeding tray, for feeding the paper pieces;

a placing member having a top surface on which tips of paper pieces stacked in said paper feeding tray are to be placed so that the tips thereof are ready for feeding, said placing member being disposable under said paper feeding roller means, in said main body of said image forming apparatus, in a manner vertically movable with respect to said main body;

stacked paper biasing means, disposable in said main body of said image forming apparatus, for upwardly biasing, through said placing member, tips of paper pieces placed on said placing member;

a pawl member, disposable in said main body of said image forming apparatus and adapted to be engaged with tips of paper pieces placed on said placing member and upwardly biased by said stacked paper biasing means, for separating an uppermost paper piece out of paper pieces stacked in said paper feeding tray from remaining paper pieces by cooperating with said paper feeding roller means;

pushing-down means, providable on said main body of said image forming apparatus, for pushing down said placing member against said stacked paper biasing means to form a space for setting tips of a plurality of paper pieces between said placing member and said pawl member; and a stopper member disposable at said paper feeding opening and movable between a regulating position for regulating insertion of paper pieces through said paper feeding opening, and a regulation-releasing position for not regulating insertion of paper pieces;

said stopper member including a plate member which is rotatably supported by said placing member and is movable between a closing position to close said paper feeding opening and an opening position to open said paper feeding opening.

2. A paper feeding device of an image forming apparatus according to claim 1, wherein said stacked paper biasing means includes a compression spring disposed between a bottom surface of said placing member and said main body of said image forming apparatus.

3. A paper feeding device of an image forming apparatus according to claim 1, wherein said device has plural pawl members and wherein each of said pawl members has a portion adapted to come in contact with tips of paper pieces placed on said placing member, and a portion adapted to come in contact with a top surface of said tips of said paper pieces.

4. A paper feeding device of an image forming apparatus according to claim 1, wherein said device has plural pawl members and wherein said pair of pawl members are removably attached to engagement portions disposed at predetermined positions with respect to said main body of said image forming apparatus, and said engagement portions are disposed at least two different positions for each of said pawl members in order to adjust a distance therebetween.

5. A paper feeding device of an image forming apparatus according to claim 7, wherein said pushing-down means includes a lever member having a base end and a tip, said base end being rotatably supported by said main body of said image forming apparatus, and said tip projecting from said main body of said image forming apparatus to outside thereof, and said lever member is provided at said tip with a finger-pushing portion.

6. A paper feeding device of an image forming apparatus according to claim 5, wherein said pushing down means further includes a placing member interlocking mechanism for interlocking with said lever member and downwardly moving said placing member in cooperation with a pushing down operation of said finger pushing portion.

7. A paper feeding device of an image forming apparatus according to claim 6, wherein said placing member interlocking mechanism includes a working lever, provided at a predetermined portion thereof with an engagement portion to be engaged with a predetermined portion of said placing member, for pushing down said placing member in association with said pushing down operation by said finger pushing portion.

8. A paper feeding device of an image forming apparatus according to claim 1, wherein said plate member is movable to said closing position by weight thereof.

9. A paper feeding device of an image forming apparatus according to claim 1, wherein said plate member is displaced to said opening position by ribs disposable at said main body of said image forming apparatus.

10. A paper feeding device of an image forming apparatus according to claim 1, further comprising a stopper-member interlocking mechanism to be interlocked with said pushing-down means, for moving said stopper member to said regulation-releasing position in cooperation with a pushing down operation by said pushing down means.

11. A paper feeding device of an image forming apparatus according to claim 1, further comprising a guide member movable between (i) a lower position where said guide member comes in contact with a top surface of tips of paper pieces inserted to a paper setting position through said paper feeding opening to guide said tips of said paper pieces to said space, and (ii) an upper position where feeding of each paper piece is allowed.

12. A paper feeding device of an image forming apparatus according to claim 11, wherein said guide member includes a plate member rotatably supported by said main body of said image forming apparatus.

13. A paper feeding device of an image forming apparatus according to claim 11, further comprising a guide-member interlocking mechanism, adapted to be operated in association with a pushing-down operation of said pushing-down means, for moving said guide member to said lower position.

14. A paper feeding device of an image forming apparatus according to claim 13, wherein said guide-member interlocking mechanism includes a working lever for pushing down said guide member in association with said pushing-down operation of said pushing-down means.

15. A paper feeding device of an image forming apparatus according to claim 13, further comprising guide member biasing means for biasing said guide member to said upper position.

16. A paper feeding device of an image forming apparatus, said device comprising:

a paper feeding tray which is disposable at a lateral side of a main body of said image forming apparatus and in which a plurality of paper pieces are to be stacked so that tips thereof are inserted into a paper feeding opening of said lateral side;

paper feeding roller means, adapted to be rotatably driven to come in contact with a top surface of paper pieces stacked in said paper feeding tray, for feeding the paper pieces;

a placing member having a top surface on which tips of paper pieces stacked in said paper feeding tray are to be placed so that the tips thereof are ready for feeding, said placing member being disposable under said paper feeding roller means, in said main body of said image forming apparatus, in a manner vertically movable with respect to said main body;

stacked paper pieces biasing means, disposable in said main body of said image forming apparatus, for upwardly biasing, through said placing member, tips of paper pieces placed on said placing member;

a pawl member, which is disposable in said main body of said image forming apparatus and is adapted to be engaged with tips of paper pieces placed on said placing member and upwardly biased by said stacked paper biasing means, for separating an uppermost paper piece out of paper pieces stacked in said paper feeding tray from remaining paper pieces by cooperating with said paper feeding roller means;

pushing-down means, providable on said main body of said image forming apparatus, for pushing down said placing member against said stacked paper pieces biasing means to form a space for setting tips of a plurality of paper pieces between said placing member and said pawl member;

a stopper member disposable at said paper feeding opening and movable between a regulating position for regulating an insertion of paper pieces through said paper feeding opening, and a regulation-releasing position for not regulating insertion of paper pieces through said opening; and a stopper-member interlocking mechanism for interlocking with said pushing-down means and moving said stopper member to said regulation-releasing position in cooperation with a pushing down operation of said pushing down means;

said stopper-member interlocking mechanism including ribs for pushing up predetermined portions of said stopper member, said ribs being disposable at said main body of said image forming apparatus.

17. A paper feeding device of an image forming apparatus, said device comprising:

a paper feeding tray which is disposable at a lateral side of a main body of said image forming apparatus and in which a plurality of paper pieces are to be stacked so that tips thereof are inserted into a paper feeding opening of said lateral side;

paper feeding roller means, adapted to be rotatably driven to come in contact with a top surface of paper pieces stacked in said paper feeding tray, for feeding the paper pieces;

a placing member having a top surface on which tips of paper pieces stacked in said paper feeding tray are to be placed so that the tips thereof are ready for feeding, said placing member being disposable under said paper feeding roller means, in said main body of said image forming apparatus, in a manner vertically movable with respect to said main body;

stacked paper pieces biasing means, disposable in said main body of said image forming apparatus, for upwardly biasing, through said placing member, tips of paper pieces placed on said placing member;

a pawl member, disposable in said main body of said image forming apparatus and adapted to be engaged with tips of paper pieces placed on said placing member and upwardly biased by said stacked paper biasing means, for separating an uppermost paper piece out of paper pieces stacked in said paper feeding tray from remaining paper pieces by cooperating with said paper feeding roller means;

pushing-down means, providable on said main body of said image forming apparatus, for pushing down said placing member against said stacked paper pieces biasing means to form a space for setting tips of a plurality of paper pieces between said placing member and said pawl member;

a guide member positioned laterally with respect to said paper feeding roller means and movable between (i) a lower position where said guide member comes in contact with a top surface of tips of paper pieces inserted to a paper setting position through said paper feeding opening to guide said tips of said paper pieces to said space, and (ii) an upper position where feeding of each paper piece is allowed;

a guide-member interlocking mechanism, adapted to be operated in association with a pushing-down operation of said pushing-down means, for moving said guide member to said lower position; and guide member biasing means for biasing said guide member to said upper position.

18. A paper feeding device according to claim 17, wherein said guide member is supported by a rotary shaft of said paper feeding roller means.

* * * * *